United States Patent [19]

Pellegri et al.

[11] 4,217,401

[45] Aug. 12, 1980

[54] BIPOLAR SEPARATOR FOR ELECTROCHEMICAL CELLS AND METHOD OF PREPARATION THEREOF

[75] Inventors: Alberto Pellegri, Luino, Italy; Placido M. Spaziante, Lugano, Switzerland

[73] Assignee: Oronzio de Nora Impianti Elettrochimici S.p.A., MIlan, Italy

[21] Appl. No.: 48,994

[22] Filed: Jun. 15, 1979

Related U.S. Application Data

[63] Continuation-in-part of Ser. No. 951,984, Oct. 16, 1978, abandoned.

[30] Foreign Application Priority Data

Jul. 10, 1978 [IT] Italy ..... 25.510 A/78

[51] Int. Cl.[2] ..... H01M 2/14

[52] U.S. Cl. ..... 429/39; 429/143; 429/210; 204/266

[58] Field of Search ..... 429/39, 210, 40, 42, 429/143, 247, 149; 204/254–256, 266, 291

[56] References Cited

U.S. PATENT DOCUMENTS

| | | | |
|---|---|---|---|
| 3,134,696 | 5/1964 | Douglus et al. | 136/86 |
| 3,746,578 | 7/1973 | Warszowski | 429/39 |
| 3,954,502 | 5/1976 | Symons | 429/39 |
| 4,039,409 | 8/1967 | Laconti et al. | 204/129 |
| 4,055,291 | 10/1977 | Peters | 204/256 X |
| 4,057,675 | 11/1977 | Halberstadt | 429/39 |
| 4,118,294 | 10/1978 | Pellegri | 204/291 X |

*Primary Examiner*—Charles F. LeFevour
*Attorney, Agent, or Firm*—Hammond & Littell, Weissenberger and Muserlian

[57] ABSTRACT

An improved electrically conductive, composite bipolar separator for electrochemical cells comprising a molded aggregate of an electrically conductive aggregate of powdered electrically conductive material and a chemically resistant resin with a vertical array of electrically conductive valve metal ribs partially embedded in the molded aggregate at least on the anode side and having the entire surface exposed to the anolyte, except the area of electrical contact with the anode, coated with a layer of a chemically resistant and electrically non-conductive resin, the said ribs being arranged to form a grid to distribute the current to the porous anode bonded on the surface of a semi-permeable membrane or diaphragm at a uniformly distributed multiplicity of points over the entire anode surface and electrochemical cells containing the said bipolar separator and method of producing the said bipolar separator.

15 Claims, 4 Drawing Figures

BIPOLAR SEPARATOR FOR ELECTROCHEMICAL CELLS AND METHOD OF PREPARATION THEREOF

PRIOR APPLICATION

This application is a continuation-in-part of our copending, commonly assigned U.S. patent application Ser. No. 951,984 filed Oct. 16, 1978 now abandoned.

STATE OF THE ART

Electrochemical cells are used as electrochemical current generators, such as primary or secondary batteries as well as electrolytic cells. Recently, electrochemical devices having a solid electrolyte have been proposed particularly to be used as fuel cells. Typical examples of solid polymer electrolyte cells are described in U.S. Pat. Nos. 3,134,696 and 4,039,409. Typically, said devices comprise essentially a solid electrolyte made of a thin sheet of an ion exchange resin, and on both surfaces thereof powder catalysts are applied and incorporated into the resin and constitute the dispersed electrodes of the cell. Metallic screens or grids or drawn thin plates are assembled in electrical contact with the electrodes bonded to the membrane or diaphragm to supply and uniformly distribute the electric current to the dispersed electrodes, depending upon whether the apparatus is used as an electrolysis cell or an electrochemical generator.

Each individual cell is hydraulically separated from the adjacent cell by a partition wall or separator which supports and is electrically connected to the screen or grid current collectors so that the electrical current flows from the anode of one cell to the cathode of the adjacent cell through the said separator. The solid polymer electrolyte cells have been studied for electrolysis processes and especially for chlorine production by electrolysis of aqueous solutions of sodium chloride or hydrochloric acid but several problems such as materials of construction and configuration of the bipolar separators remain.

Electrolysis cells differ from gaseous fuel cells in that liquid electrolyte is circulated in the electrode compartments and at the same time the gaseous products of the electrochemical reaction are released at the electrodes. Therefore, the configuration of the bipolar separator and of the current distribution means to the electrodes bonded to the membrane surface must fulfill hydrodynamic requirements to assure an effective mass transfer to and from the electrode surfaces to avoid undesired parasitic electrode reactions. Moreover, the gas evolved at the electrodes must be rapidly removed from the electrode surface to avoid gas blanketing effects. Bipolar separators must also be corrosion resistant for example to concentrated caustic soda on the cathode side and to hydrochloric acid and wet chlorine on the anode side. Another essential requirement for the bipolar separator is a high resistance to atomic hydrogen diffusion and hydrogen embrittlement.

In copending U.S. patent application Ser. No. 873,509 filed Jan. 30, 1978, now U.S. Pat. No. 4,197,178 a new bipolar separator and a method of preparation thereof is described. This separator is impervious to atomic hydrogen diffusion, chemically and mechanically stable and is formed by heat and pressure molding from a mixture of powdered graphite and/or metal such as titanium, zirconium, niobium and resin, preferably thermosetting resins such as an epoxide resin in a weight ratio of 1:1 to 9:1. The separator obtained thereby exhibits a high density of contact areas thus enhancing a good flow of the electrolyte along the surface of the electrodes bonded to the membrane.

The method of preparation described in the aforesaid patent application results in bipolar separators having a resistivity in the direction perpendicular to the major surfaces of the separator less than 0.3 Ωcm. All the surfaces, except the area of electrical contact, are coated with a layer of electrically insulating resin. The areas of electrical contact are covered with a galvanically deposited layer of platinum or other metals of the platinum metal group. The bipolar separator disclosed in the said copending patent application overcomes the cited problems, but the platinum coating of the anodic contact areas may be easily damaged during handling since the supporting aggregate has a limited hardness. When accidental scratches are not detected and opportunely repaired before start-up, the resin aggregate undergoes an electrochemical attack and the bipolar separator contact areas to the electrodes of the cell are rapidly degraded.

OBJECTS OF THE INVENTION

It is an object of the invention to provide a new and improved bipolar separator for solid polymer electrolyte cells, particularly suited for electrolysis of aqueous solutions of alkali metal halides or hydrochloric acid but which may be as well utilized for other electrolysis cells.

It is another object of the invention to provide improved electrolysis cells provided with the said bipolar separators.

These and other objects and advantages of the invention will become obvious from the following detailed description.

THE INVENTION

The novel bipolar separator of the invention is comprised of a rigid, molded aggregate of an electrically conductive powdered material and a chemically resistant resin with a vertical array of electrically conductive metal ribs partially embedded in the molded aggregate at least on the anode side and having the entire surface exposed to the anolyte, except the area of electrical contact with the anode, coated with a layer of a chemically resistant and electrically non-conductive resin, the said ribs being arranged to form a grid to distribute electrical current to the anode bonded on the surface of a semi-permeable membrane or diaphragm at a uniformly distributed multiplicity of points over the entire anode surface.

Preferably, the ribs or extensions are made of a valve metal rod such as titanium, tantalum, zirconium, hafnium, niobium, tungsten, silicon or alloys thereof and are optionally coated with a non-passivating material such as a platinum group metal or oxides thereof and/or conductive oxides of other metals such as cobalt, lead, iron or manganese. When the ribs are in direct contact with the anode, they are provided with a non-passivatable coating. However, in the preferred embodiments, the ribs are in contact with a foraminous screen which is coated with a non-passivating material and the ribs are uncoated.

The rods are laid in the mold and are embedded in the resin aggregate during the molding of the separator. Preferably, the rods are arranged in a spaced parallel array to form a grid with a surface extension substantially identical to the surface of the electrode bonded to the membrane surface to uniformly distribute current at a multiplicity of contact points over the entire electrode surface. The rods are arranged vertically and the spaces between the rods form vertical grooves for circulation of the electrolyte and gaseous anodic products.

The cathode surface of the bipolar separator may also be provided with a series of extensions or ribs made of catholyte resistant material partially embedded in the resin aggregate similar to the anode surface but preferably the extensions are made of the aggregate material per se and are generated during forming in a suitable mold as described in U.S. patent application Ser. No. 873,509.

The surfaces of the bipolar separator with the exception of the areas of electrical contact with the electrodes are coated with a thin layer of a chemically resistant, nonconductive resin to electrically insulate the said surface of the separator in contact with the electrolyte.

The bipolar separator of the instant invention is preferably made of a pressure molded aggregate of carbon, graphite and/or metallic powder and of chemically resistant resin in a weight ratio of between 1:1 and 9:1. The aggregate has coefficient of resistivity in the direction perpendicular to the major surfaces of the separator less than 0.3 Ωcm and has the whole surface exposed to the anolyte coated with a layer of chemically resistant and electrically insulating resin. The resin used must withstand chemical attack by the electrolyte and must have a temperature handling capability of up to 100° C. It is preferably a thermosetting resin but it may also be a thermoplastic resin, which resists softening up to the temperature of operation.

According to the method of the invention, the bipolar separator is made by pressure molding conveniently providing for generating the recessed surfaces, the projections for the electrical contacts, the grooves and the holes for the circulation of the reagents and the recovery of the products of reaction and the holes for the passage of assembly tie-rods in a single operation of manufacture.

The method of preparation of the bipolar separator of the invention comprises mixing graphite and/or metal particules having a grain size of preferably between 150 and 350 mesh with either a thermosetting resin usually in liquid form or with thermoplastic resin, usually in powder form, in a weight ratio between 1:1 and 9:1. The mixture is then transferred into a mold which may be provided with an anti-adhesive coating such as teflon or other suitable lubricating material and in which the metal rods have been appropriately aligned and is initially pressed at least at 0.5 kg/cm$^2$ and preferably about 4 kg/cm$^2$.

Under these forming conditions, an anysotropy is induced into the material and a greater density of "electric paths" is obtained which can be imagined as chains of conductive graphite or metal particles contacting each other, in a direction perpendicular to the major surfaces of the molded article with respect to the density of "electric paths" along planes parallel to the major surfaces. Therefore, a maximum conductivity in the useful direction corresponding to the direction of the current flow across the bipolar separator during operation is achieved.

Adequate temperature is applied to the mold either for curing the thermosetting resin while maintaining the mixture under the molding pressure for a time sufficient to substantially harden the aggregate or for sintering the thermoplastic resin to effect aggregation of the mixture.

During this process the valve metal rods become securely embedded, for a portion thereof, into the aggregate and the embedded portion of the surface of the valve metal rods results in intimate electrical contact with the conductive aggregate.

After cooling, at least the anodic side of the separator, but preferably both sides thereof, are provided with a coating, about 30 to 500 μm thick, of unloaded chemically resistant thermosetting resin, except for the metal rods. This may be conveniently done utilizing the same mold, or a similar mold, by first applying, over the mold and/or the separator surfaces a sufficient amount of thermosetting resin, preferably in liquid form, and then closing the mold again over the separator and curing the resin coating under a small pressure for the time necessary to obtain complete hardening of the resin. Again, chemically resistant thermoplastic resin may be used, in place of thermosetting resin, to coat the surface of the aggregate exposed to the anolyte. In this case, the insulating resin layer is applied by pressing the resin, preferably in powder form, over the surface of the aggregate at a temperature sufficiently high, to cause softening and subsequent sintering of the resin.

Finally, the areas of contact on the cathode side at the vertex of the projections of the separator are conveniently buffed with a fine abrasive or machined in order to remove the insulating sheath of unloaded resin and to expose the electrically conductive aggregate. By appropriate design of the mold, the machined surface at the vertex of the cathodic projections and the vertex of the valve metal ribs embedded on the anodic side may both be made co-planar or substantially so, with the peripheral mating surfaces of the separator for a gasket-less assembly. That is, the molding peripheral surfaces of the separators are pressed against the solid polymer electrolyte membrane and provide for the hydraulic sealing of the cells without the use of any gasket.

The layer of unloaded resin makes the covered surfaces of the separator electrically insulating with respect to the ionic species, therefore preventing those portions of the surface of the separator from operating as an anode which causes a rapid failure because of the discharge of anions such as halogen ions on the surface of the conductive aggregate.

Examples of the thermosetting resins which can be used both for the aggregate body of the separator as well as for the insulating coating thereof are polyesters, phenolics, furanic and epoxide resins. Examples of heat resistant thermoplastic resins which can be used for the aggregate body of the separator and for the insulating coating thereof are helocarbon resins such as polyvinyldene fluoride, polyvinyldene chloride etc. Two-component resins of the epoxy or modified epoxy base with aromatic amine additives as hardeners are exceptionally suitable for the objects of the invention. In particular, epoxy base resins confer excellent mechanical properties to the aggregate and permit higher loadings of conductive powders as compared to other types of resins.

For instance, the load of graphite powder can be increased up to 90% by weight, thus providing for a very good electrical conductivity of the aggregate, and still obtain cured separators with excellent mechanical properties, especially with respect to the impact resistance and to flexure resistance. Moreover, the choice of aromatic amines as the hardener improves the acid resistance of the resin and its resistance to high temperatures. Separators prepared by the method of the invention were not dimensionally deformed after remaining for 2 hours at 150° C.

A particularly suitable thermoplastic resin is polyvinyldene fluoride resin, such as marketed by Pennwalt Chemical Corporation under the trade name of KYNAR.

Metal powders may be used, but graphite or carbon powder are preferably used for loading the resin. The bipolar separator of the invention and the method of its preparation are described in more detail in the following figures and specific example which relate to a solid electrolyte cell utilized for the electrolysis of aqueous solutions of sodium chloride embodying the bipolar separator of the invention.

In a preferred embodiment of the invention, an electrically conductive element with a foraminous, fine mesh structure coated with a non-passivating material having a high ratio of empty spaces to closed spaces and a certain resiliency is inserted between the uncoated valve metal ribs and the porous anode bonded to the membrane or diaphragm surface whereby electrical current is supplied to the bonded electrode at a large number of contact points. Moreover, the intrinsic resiliency of the conductive element guarantees good electrical contact over the entire bipolar separator surface and will compensate for any small deviations from perfect planarity of the contact surface. In this latter case, this prevents piercing of the membrane during cell assembly or by any excessive pressure which might be exerted at certain points during operation.

The aforesaid resilient, electrically conductive elements are preferably made of two or more valve metal screens provided with a non-passivating coating, similiar to the coating utilized for the ribs imbedded in the aggregate. The screens are laid one upon the other and may be welded together along their perimeters. The screens or expanded sheets have a fine mesh structure and a ratio between closed and empty areas equal to or less than 1 and their thickness is preferably between 0.10 and 1.5 mm. The screens are laid one upon the other to increase the resiliency of the structure when the screen pack is pressed between the ribs on the anode side of the bipolar separator and the membrane carrying the porous anode bonded thereto during cell assembly.

The bipolar separator of the present invention is now described by referring to the drawings which show a typical embodiment of a solid electrolyte cell for the electrolysis of aqueous solutions of sodium chloride and hydrochloric acid. However, it must be understood that the invention is not intended to be limited by this specific embodiment.

Figure 1:
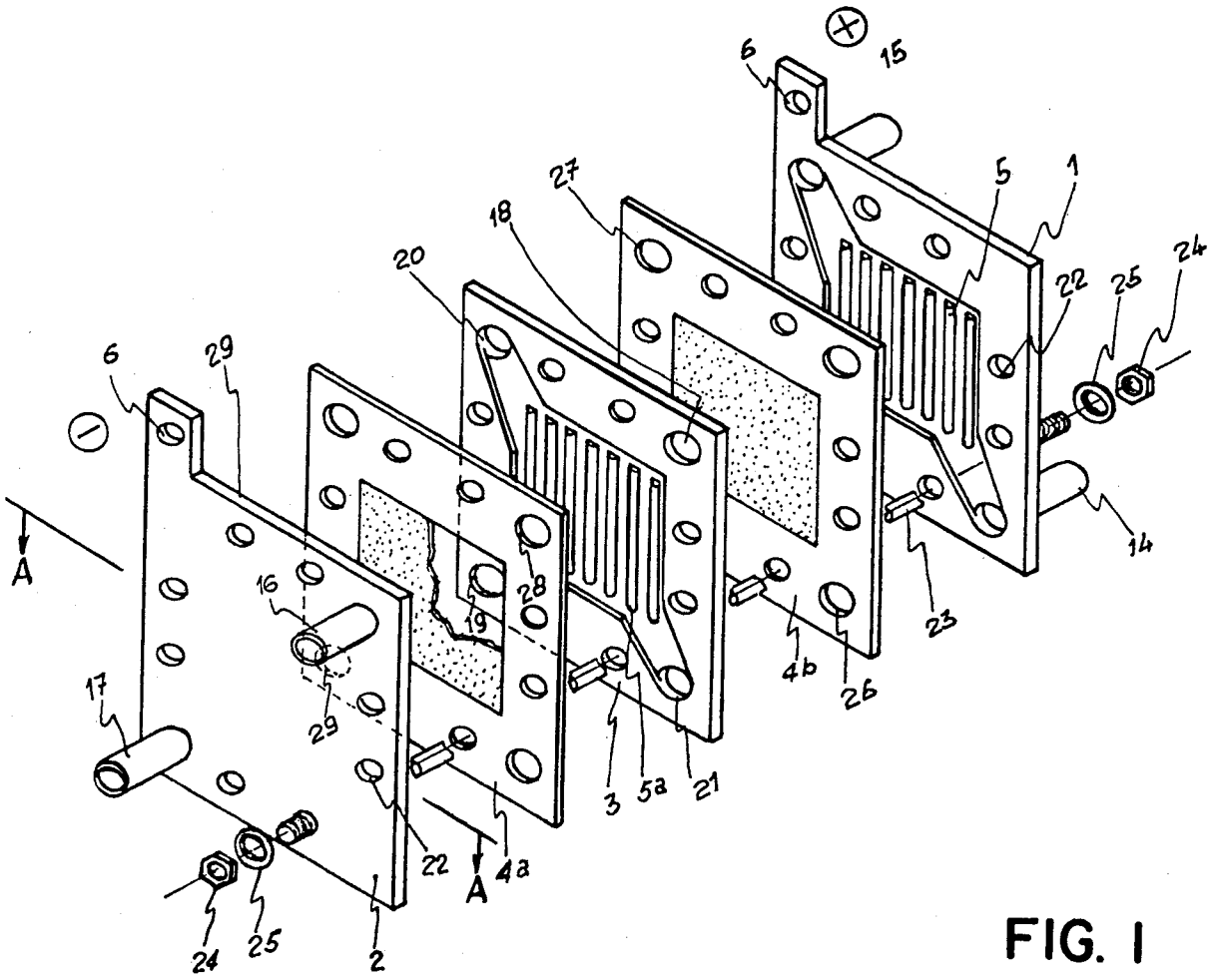
FIG. 1 is a schematic perspective exploded view of a solid polymer electrolyte cell utilizing a bipolar separator of the invention.

With reference to FIGS. 1, 2, 3 and 4 wherein the same parts are identified by the same number, the cell is comprised of an anode end plate 1, a cathode end plate 2, a bipolar separator 3 and two membranes 4*a* and 4*b* onto whose surfaces electrodes 8,9,10 and 11 have been bonded. Both the anode end plate 1 and the cathode end plate 2 are also made of a rigid electrically conductive aggregate of electrically conductive powdered material and chemically resistant resin formed by molding and heating with the same method used to produce the bipolar separator 3. The anode end plate 1 is provided on its internal central surface with a series of partially embedded titanium rods 5 coated with a non-passivating material such as platinum identical to the rods 5*a* partially embedded on the anode side of bipolar separator 3. The resulting grooves between the said rods are hydraulically connected to anolyte inlet 14 and to spent anolyte outlet 15.

Similarly, the cathode end plate 2 is provided over its internal surface thereof with a grooved central zone identical to grooves 12 of the cathode side of bipolar separator 3 which are hydraulically connected to outlets 16 and 17 of the reaction effluents. Both end plates 1 and 2 are provided with electrical connection means 6 to the respective poles of the electric source.

Bipolar separator 3 is provided on the cathode side with grooves 12 connected to holes 18 and 19, respectively co-axial to outlets 16 and 17 of the cathode end plate and to holes 28 and 29 of membrane 4*a*, while grooves 13 of said bipolar separators are connected to holes 20, 21, 26 and 27 co-axial to anolyte outlet 15 and inlet 14.

Figure 2:
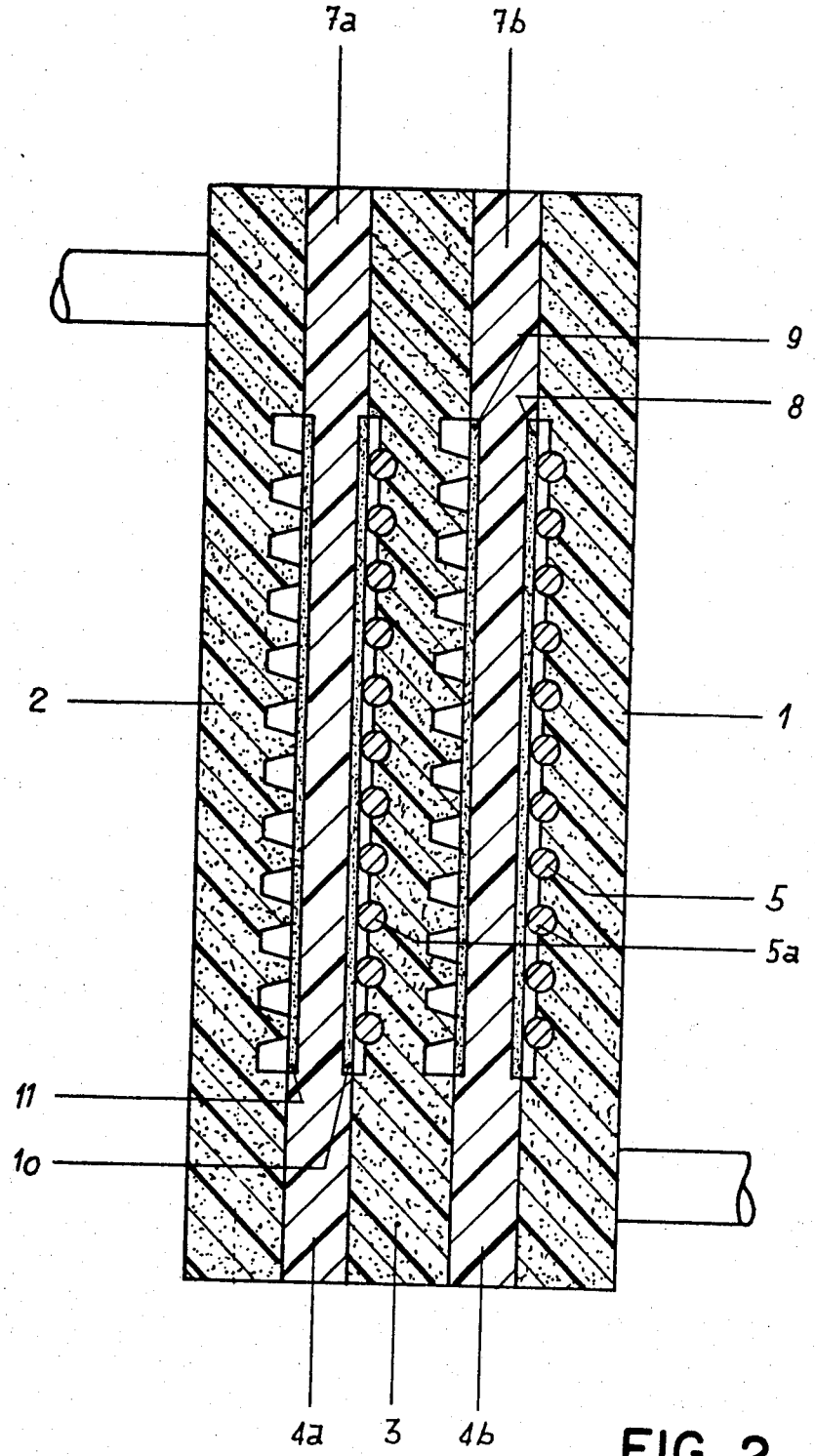
FIG. 2 is a horizontal cross-section along lines A-A of FIG. 1.

The first unit cell membrane 4*b* consists of a sheet of ion-exchange resin 7*b* onto whose central zone the anode 8 and the cathode 9 are incorporated. Similarly, membrane 4*a* consists of a sheet of resin 7*a* carrying the method electrodes 10 and 11. The two end plates, the membranes and the bipolar separator are provided with co-axial holes 22 for the passage of assembling tie-rods 23 made of nylon, teflon or other electrically insulated material for cell assembly, said tie-rods being tightened by pairs of nuts 24 and washers 25. When the cell is assembled as shown in FIG. 2, the peripheral surfaces of the two end plates 1 and 2 and of the bipolar separator 3 form a hydraulic sealing by being pressed against the peripheral surfaces of membrane 4*a* and 4*b*.

The coated titanium ribs of the anode end plate 1 contact over a multiplicity of points the porous anode 8 bonded to membrane 4*b*, the projections of the grooved central zone of the cathode side of the bipolar separator 3 contact over a multiplicity of points the porous cathode 9 bonded to membrane 4*b* and the coated titanium ribs 5*a* of separator 3 contact over a multiplicity of points the porous anode 10 bonded to membrane 4*a*, while the projections of the cathode end plate 2 contact over a multiplicity of points the porous cathode 11 bonded to membrane 4*a*. In this way, a succession of unit cells is established and the number of cell units can be increased at will by inserting more bipolar separators and membranes carrying the bonded electrodes in electrical series.

Figure 3:
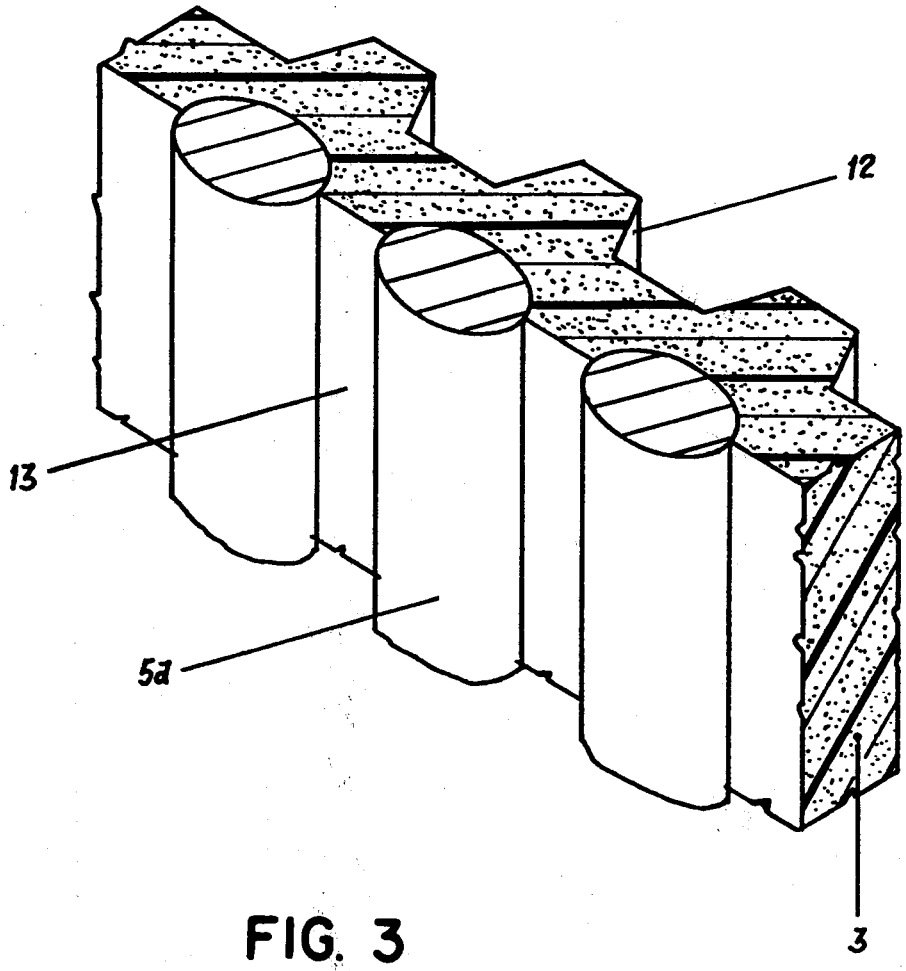
FIG. 3 is a perspective cross-sectional view of the bipolar separator of the present invention.

FIG. 3 illustrates an enlarged partial cross-section of the bipolar separator of the instant invention. The titanium rods 5*a*, coated with a layer of non passivatable material such as platinum, are partially embedded in the conductive aggregate forming the separator. Spaces 13 between adjacent rods 5*a* form channels for the circulation of the anolyte and products of the anodic reaction. Projections 12 of the cathodic side of the molded separator contact, at their vertexes, the cathode bonded to the membrane of one unit cell and the conductive titanium rods 5*a* contact, along their generatrix, the anode bonded to the membrane of the adjacent unit cell. Therefore electrical current from the anode of one unit cell is conducted to the cathode of the adjacent unit cell through the bipolar separator.

Figure 4:
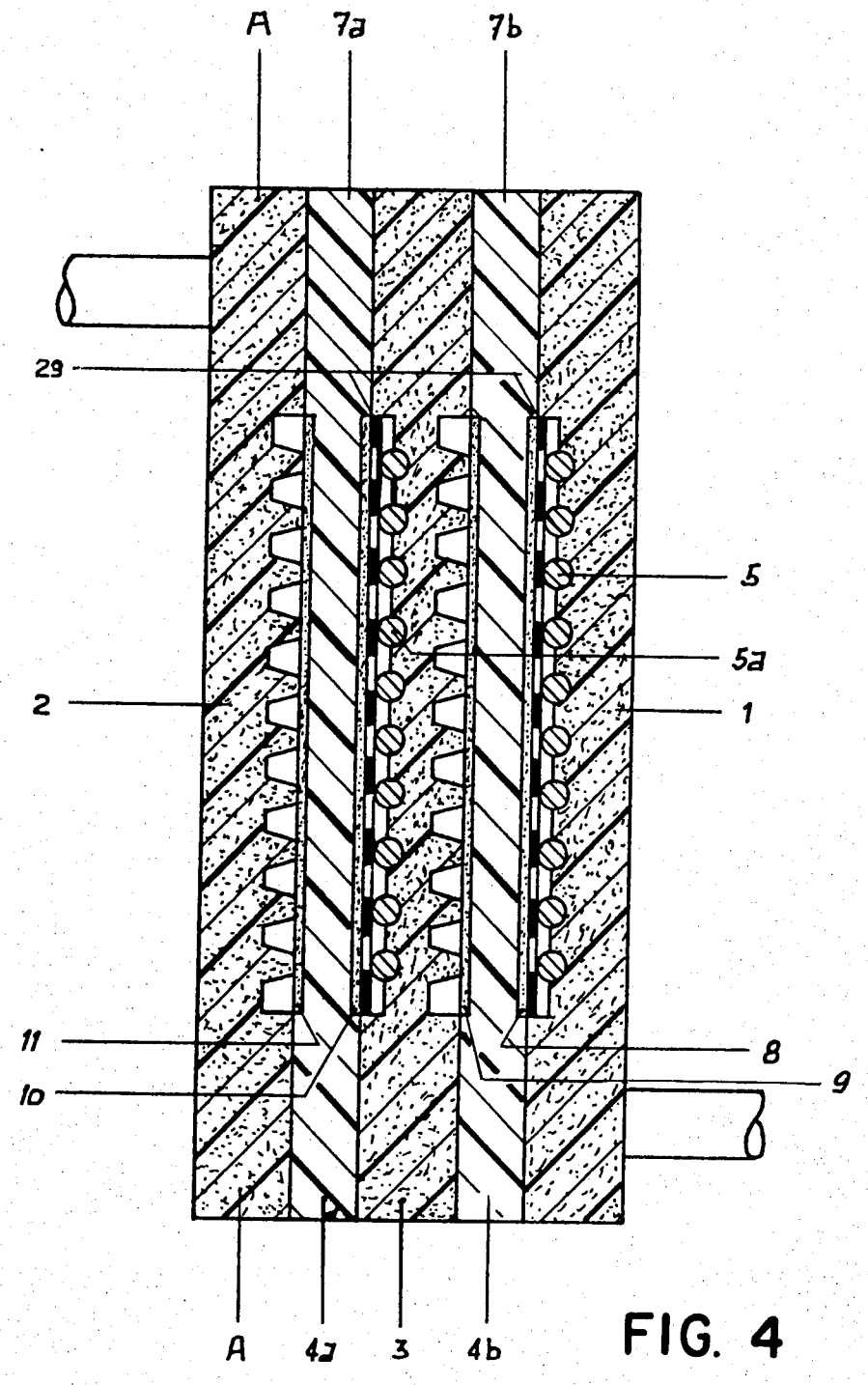
FIG. 4 is a cross-sectional view of a cell of the invention with a bipolar separator having an electrically conductive screen insert interposed between the metal ribs of the separator and the porous anode bonded to the membrane.

FIG. 4 illustrates the insertion of a resilient, electrically conductive element 29 between the titanium rods 5 and anodes 8 and 10 for achieving the aforesaid objects. Elements 29 consists of three titanium screens of expanded titanium sheets with a thickness of 0.1 mm and a ratio of empty and closed areas equal to 1, said screens being welded along their perimeters.

During operation of the cell, electrolyte is introduced into the cell through inlet 6 of the anode end plate and is distributed into the first anode compartment defined by the grooves in the central zone of the anode side of the bipolar separator 3. The electrolyte is discharged together with the products of the anodic reaction through holes 20 and 27. Similarly, the products forming at the cathode collect in the two cathode compartments and are recovered through outlets 16 and 17 of the cathode end plate 2.

When the illustrated cell is used for electrolysis of aqueous solution of sodium chloride, chlorine is evolved at anodes 8 and 10 and the chlorine is carried along with the flow of the electrolyte along the grooves and through holes 20 and 27 and is recovered from the cell through outlet 15 together with the spent electrolyte. Solvated sodium ions migrate through cationic exchange membranes **4*a* and 4*b* and at cathodes 9, hydrogen is evolved and sodium hydroxide is formed. Hydrogen flows through holes 18 and 28 leaving the cell through outlet 16 together with the hydrogen formed in the cathode compartment of the cathode end plate. Aqueous sodium hydroxide flows through holes 19 and 29 together with the solution collected in the cathode compartment of end plate 2 and is recovered through outlet 17. In case the type of cationic membrane used does not allow a sufficient transfer of cations, water or dilute caustic may be circulated in the cathode compartment through inlet 17 and outlet 16** to dilute the sodium hydroxide formed, carrying with it the hydrogen discharged at the cathodes.

If the cell is utilized for the electrolysis of aqueous solutions of hydrochloric acid, the method of operation is the same as for sodium chloride except for water circulation in the cathode compartment which is no longer required as hydrogen is the only reduction product and the cathode surface is sufficiently wetted by the flow of the solvation water through the membrane.

In the following example there are described several preferred embodiments to illustrate the invention. However, it is to be understood that the invention is not intended to be limited to the specific embodiments.

EXAMPLE 1

100 parts of XG 7, an epoxy type resin, and 52 parts of XG 8, an aromatic amine hardener, both manufactured by Ciba-Geigy were thoroughly mixed and graphite powder having a granulometry comprised between 150 and 350 mesh were added to the mixture in a weight ratio of the two-component resin and graphite of 3:7. The mixture was thoroughly homogenized in a mixer and the mixture was poured into a teflon mode made in the shape of the bipolar separator 3 illustrated in more detail in FIG. 3 whose bottom contained an array of titanium rods coated with a platinum-iridium layer 1 μm thick. The rods had a diameter of 3 mm and were spaced 3 mm apart. The mold was provided with a cover profiled to obtain projections 12 of FIG. 3. The mixture was pressed in a way so as to provoke a substantial plastic flow oriented along planes parallel to the major surfaces of the bipolar separator which was achieved by providing for expulsion of any excess mixture from the mold through radial holes co-planar with the major surface of the mold.

The thickness of the separator was 5 mm and the depth of the grooves was 2 mm with respect to the flat surface. The mold was held in an oven at 100° C. for 8 hours while maintaining the forming pressure on the mold.

After cooling and extracting the bipolar separator from the mold, the molded separator was coated, by brushing, with an unloaded resin mixture of XG 7 (100 parts) and XG 8 (52 parts) to which a commercial thixotropic additive ($SiO_2$) has been added to reduce the surface tension of the resin mixture, thereby facilitating even application of the coating over the entire surface of the bipolar separator. The coated separator was then cured in an oven at 100° C. for 5 hours and the thickness of the hardened resin coating was about 200 μm.

The contact surface on the cathode side, that is the vertexed of the projections 12 were treated with an abrasive to remove the coating layer of unloaded (non-conductive) resin which had been applied over the whole surface of the bipolar separator as described in the preceding paragraph. The exposed contact surface were then coated with a galvanically deposited layer of platinum-iridium alloy having a thickness of about 1 μm.

Also, the two end plates of 1 and 2 of the cell described in FIGS. 1 and 2 were prepared by the procedure described for the preparation of the bipolar separator 3. The resilient, conductive element of FIG. 4 was prepared by welding three expanded titanium meshes along their perimeter. The meshes had a thickness of 0.1 mm each and a ratio of closed spaces to open spaces of approximately 1. The welded meshes were then galvanically provided with a 1 μm thick platinum-iridium alloy layer.

The ion-exchange membranes or solid polymer electrolyte **4*a* and 4*b*** were of the cationic type and comprised of a sheet of sulfonated co-polymer of acrylic acid and styrene cross-linked with divinylbenzene and porous anodes and cathodes of finely divided platinum black powder were incorporated on to the surfaces of the membranes by pressing. The amount of platinum black was about 0.010 g/cm$^2$.

The cell was satisfactorily used for the electrolysis of aqueous solution of sodium chloride to form chlorine with the operating conditions reported in Table I.

TABLE I

| | |
|---|---|
| Electrolyte | NaCl at 295 g/l |
| Temperature | 60° C. |
| Current density | 10,000 A/m$^2$ |
| Unit Cell Voltage | 2.98 V |
| Current Efficiency | 90% |

Various modifications of the separator, cell and method of the invention may be made without departing from the spirit or scope thereof and it should be understood that the invention is to be limited only as defined in the appended claims. For example, while the described cell is provided with dispersed electrodes directly incorporated into the membrane (or solid electrolyte), it is understood that the bipolar separator of the invention may be utilized in bipolar cells wherein the electrodes are not physically incorporated into the membrane but they may be meshes or expanded metal structures opportunely activated to operate satisfactorily as electrodes, in which case the bipolar separator is in electrical contact with said electrodes.

We claim:

1. A bipolar separator for electrochemical cells, said separator constructed and arranged for distributing electrical current to an anode which is bonded to the surface of a semi-permeable membrane or diaphragm, said separator comprising a rigid, molded aggregate of an electrically conductive powdered material and a chemically resistant resin with a vertical array of electrically conductive valve metal ribs partially embedded in the molded aggregate at least on the anode side and having the entire surface of the aggregate which is exposed to the anolyte, coated with a layer of a chemically resistant and electrically nonconductive resin, the said ribs being arranged to form a grid to distribute electric current to the anode at a uniformly distributed multiplicity of points over the entire anode surface.

2. The bipolar separator of claim 1 wherein the resin is a two-component mixture of an epoxy resin and an aromatic amine hardener.

3. The bipolar separator of claim 1 wherein the powder of electrically conductive material is graphite powder.

4. The bipolar separator of claim 1 wherein the electrically conductive valve metal ribs are titanium rods coated with a layer of a non-passivatable material.

5. The bipolar separator of claim 1 wherein the electrically conductive valve metal ribs are coated with non-passivatable material which is at least one member of the group consisting of platinum, rhodium, ruthenium, palladium, osmium and iridium and oxides thereof.

6. The bipolar separator of claim 1 wherein the molded separator is provided over both its major surfaces with a recessed central zone and a substantially flat peripheral zone, at least four holes within said flat peripheral zone, said four holes being hydraulically connected in pairs respectively to each of the recessed central zones on each of the major surfaces of the separator, projections within said recessed central zone on the cathode side surface of the separator, said projections constituting the means for establishing the electrical contact between the bipolar separator and the cathode of one cell, an array of valve metal ribs, partially embedded in the electrically conductive aggregate, within said recessed central zone on the anode side surface of the separator, said ribs constituting means for establishing the electrical contact between the bipolar separator and the anode of the adjacent cell.

7. The bipolar separator of claim 6 wherein the entire surface of the electrically conductive aggregate exposed to contact with the electrolyte, with the exception of the areas for the electrical contact with the electrodes of the cell, are coated with a layer of electrically insulating resin and the areas of electrical contact with the electrodes of the cell are coated with a layer of a non-passivatable material comprising one member of the group consisting of Pt, Rh, Ru, Pd, Os, Ir and oxides thereof.

8. In an electrochemical cell with a plurality of uni cells in electrical series, each uni cell containing a porous anode and a porous cathode respectively bonded onto the opposite surfaces of an ion exchange membrane and wherein individual unit cells are separated by a bipolar separator which conducts electric current from the anode of one unit cell to the cathode of the adjacent unit cell, the improvement comprising using the separator of claim 1 as the bipolar separator.

9. The cell of claim 8 provided with a foraminous, electrically conductive, fine mesh element coated with a non-passivating material is in electrical contact with the ribs of the separator and the anode.

10. The cell of claim 8 wherein the resin is a two-compoenent mixture of an epoxy resin and an aromatic amine hardener.

11. The cell of claim 8 wherein the powder of electrically conductive material is graphite powder.

12. The cell of claim 8 wherein the ribs are titanium rods coated with a layer of a non-passivatable material.

13. The cell of claim 8 wherein the ribs are coated with at least one member of the group consisting of platinum, rhodium, ruthenium, palladium, osmium and iridium and oxides thereof.

14. The cell of claim 8 wherein the molded separator is provided over both its major surfaces with a recessed central zone and a substantially flat peripheral zone, at least four holes within said flat peripheral zone, said four holes being hydraulically connected in pairs respectively to each of the recessed central zones on each of the major surfaces of the separator, projections within said recessed central zone on the cathode side surface of the separator, said projections constituting the means for establishing the electrical contact between the bipolar separator and the cathode of one unit cell, an array of valve metal ribs, partially embedded in electrically conductive aggregate within said recessed central zone on the anode side surface of the separator, said ribs constituting means for establishing the electrical contact between the bipolar separator and the anode of the adjacent cell.

15. The cell of claim 8 wherein the entire surface of the electrically conductive aggregate exposed to contact with the electrolyte, with the exception of the areas for the electrical contact with the electrodes of the cell, are coated with a layer of electrically insulating resin and the areas of electrical contact with the electrodes of the cell are coated with a layer of a non-passivatable material comprising one member of the group consisting of Pt, Rh, Ru, Pd, Os, Ir and oxides thereof.

* * * * *